US008919073B2

(12) United States Patent
Cashman

(10) Patent No.: US 8,919,073 B2
(45) Date of Patent: Dec. 30, 2014

(54) BUILDING TRIM HAVING SLIDABLE MOULDING

(76) Inventor: Daniel J. Cashman, Suffield, CT (US)

( * ) Notice: Subject to any disclaimer, the term of this patent is extended or adjusted under 35 U.S.C. 154(b) by 400 days.

(21) Appl. No.: 12/925,478

(22) Filed: Oct. 22, 2010

(65) Prior Publication Data

US 2012/0096788 A1 Apr. 26, 2012

(51) Int. Cl.

| | |
|---|---|
| ***E06B 1/00*** | (2006.01) |
| ***E06B 1/34*** | (2006.01) |
| ***E04F 13/073*** | (2006.01) |
| ***E04F 19/02*** | (2006.01) |
| *E04F 13/08* | (2006.01) |
| *E06B 1/62* | (2006.01) |

(52) U.S. Cl.

CPC ..... *E06B 1/34* (2013.01); *E04F 13/0736* (2013.01); *E04F 19/02* (2013.01); *E04F 13/0864* (2013.01); *E06B 2001/628* (2013.01)

USPC ..... 52/717.01; 52/656.2; 52/288.1; 52/212

(58) Field of Classification Search

USPC ..... 52/204.1, 211, 212, 204.5, 204.53, 52/204.54, 204.55, 204.56, 204.62, 656.2, 52/656.7, 656.5, 287.1, 288.1, 717.01

See application file for complete search history.

(56) References Cited

U.S. PATENT DOCUMENTS

| | | | | |
|---|---|---|---|---|
| 5,096,753 | A * | 3/1992 | McCue et al. | 428/31 |
| 5,179,811 | A * | 1/1993 | Walker et al. | 52/288.1 |
| 5,651,222 | A * | 7/1997 | Bridges et al. | 52/211 |
| 5,678,367 | A * | 10/1997 | Kline | 52/211 |
| 5,966,880 | A * | 10/1999 | Bridges et al. | 52/211 |
| 6,332,294 | B1 * | 12/2001 | Carranza | 52/204.1 |
| 6,718,716 | B2 * | 4/2004 | Cowie | 52/404.1 |
| 7,034,221 | B2 * | 4/2006 | Johnston et al. | 52/220.7 |
| 7,210,272 | B2 * | 5/2007 | Friday | 52/288.1 |
| 7,997,043 | B1 * | 8/2011 | MacMillan et al. | 52/716.8 |
| 8,011,139 | B2 * | 9/2011 | Cashman | 52/36.3 |
| 8,061,093 | B2 * | 11/2011 | Cashman | 52/213 |
| 2005/0011657 | A1 * | 1/2005 | Johnston et al. | 174/48 |
| 2005/0034388 | A1 * | 2/2005 | Bealko | 52/204.5 |
| 2005/0198914 | A1 * | 9/2005 | Lyons et al. | 52/36.3 |
| 2006/0272238 | A1 * | 12/2006 | Honda | 52/211 |
| 2007/0119107 | A1 * | 5/2007 | Shaw et al. | 52/287.1 |
| 2007/0193197 | A1 * | 8/2007 | Vagedes | 52/716.1 |
| 2007/0199260 | A1 * | 8/2007 | Jensen | 52/204.1 |
| 2008/0172977 | A1 * | 7/2008 | Miller | 52/710 |
| 2008/0172978 | A1 * | 7/2008 | Caruso | 52/716.8 |

* cited by examiner

*Primary Examiner* — Brian Glessner
*Assistant Examiner* — Jessie Fonseca
(74) *Attorney, Agent, or Firm* — Alix, Yale & Ristas, LLP

(57) ABSTRACT

Nail or screw holes are provided on the body of a trim unit so that the trim body can be more robustly secured to the building structure, beneath a slidable molding which in a first position reveals these holes and in a second position covers the holes. This sliding is preferably achieved by a self-retaining interference connection, such as a dovetail joint, between a movable molding part and the body of the trim unit. In a further preference, the molding has a stationary portion that is fixed with respect to the trim body, and a movable portion which, after attachment of the trim body to the structural member, can be slid into engagement with the stationary portion and glued thereon to complete the molding.

13 Claims, 6 Drawing Sheets

BUILDING TRIM HAVING SLIDABLE MOULDING

RELATED APPLICATIONS

This application claims the benefit under 35 U.S.C. Sec. 120, of copending U.S. application Ser. No. 12/152,068 filed May 12, 2008 for "Window Frame With Hidden Nailing Channel" and U.S. application Ser. No. 12/383,976 filed Mar. 31, 2009 for "Prefabricated Corner Post."

BACKGROUND

The present invention relates to building construction and in particular to the installation of trim on the building exterior.

Such trim can, for example, be a frame for doors, windows, and other wall penetrations, four-sided columns, two-sided corner simulations of columns, or simply simulation of a front face of a column. Trim units of this kind are shown and described in U.S. Pat. Pub. 2009/0277110 and (as yet unpublished) U.S. patent application Ser. No. 12/383,976. These documents show techniques for mounting the trim via mounting strips to structural members such as walls or posts. However, some trim units can be very heavy and the need arises for easily securing these trim members in a more robust fashion to the structural member.

SUMMARY OF THE INVENTION

In one broad aspect, the invention is directed to providing nail or screw holes on the body of the trim unit so that the trim body can be more robustly secured to the building structure, beneath a slidable moulding which in a first position reveals these holes and in a second position covers the holes.

This sliding is preferably achieved by a self-retaining interference connection, such as a dovetail joint, between a movable moulding part and the body of the trim unit.

In a further preference, the moulding has a stationary portion that is fixed with respect to the trim body, and a movable portion which, after attachment of the trim body to the structural member, can be slid into engagement with the stationary portion and glued thereon to complete the moulding.

In the end-use embodiment, the building construction trim unit comprises a body attached to a building and the body has an associated decorative moulding. The body has an installation side bearing on a structural member of the building and a front side opposite the installation side. At least one hole passes from the front side to the installation side. A slidable connection is provided between the moulding and the body whereby in one end position the moulding exposes the hole to receive a fastener into the structural member and in another end position the moulding covers the hole.

Those familiar with the construction trades will readily appreciate that the trim unit disclosed herein provides for quick, efficient, and aesthetically clean decoration on a wide variety of building surfaces such as window trim, four-sided posts, and simulated columns. The trim unit body is rigidly attachable to the building structure and the associated moulding is rigidly attachable to the trim body without the need for externally driven nails or screws.

BRIEF DESCRIPTION OF THE DRAWING

Various embodiments will are described below with reference to the accompanying drawing, in which.

DETAILED DESCRIPTION

Figure 1:
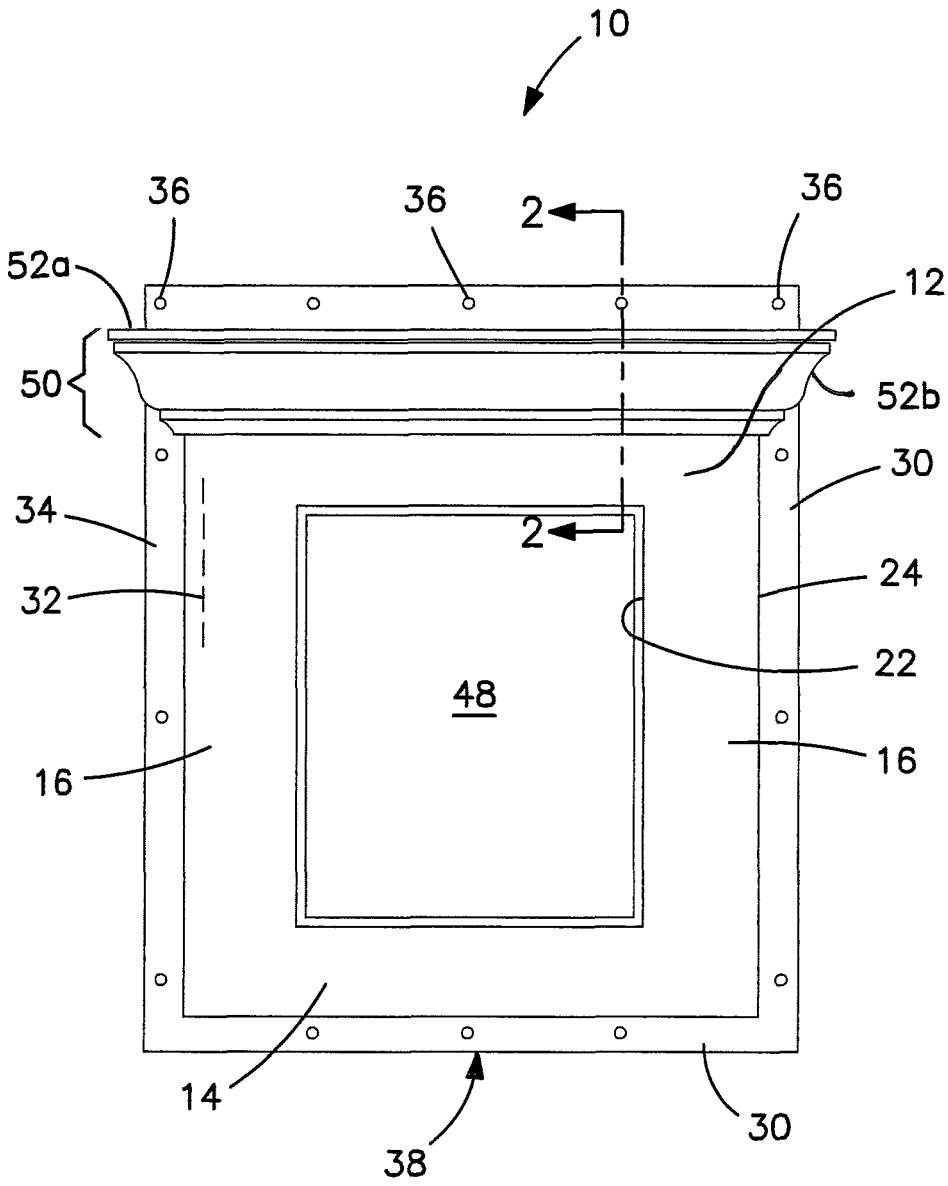
FIG. 1 is an elevation view of a window frame constituting a trim unit for a window box, showing moulding secured on the top frame element according to one embodiment.
Figure 2:
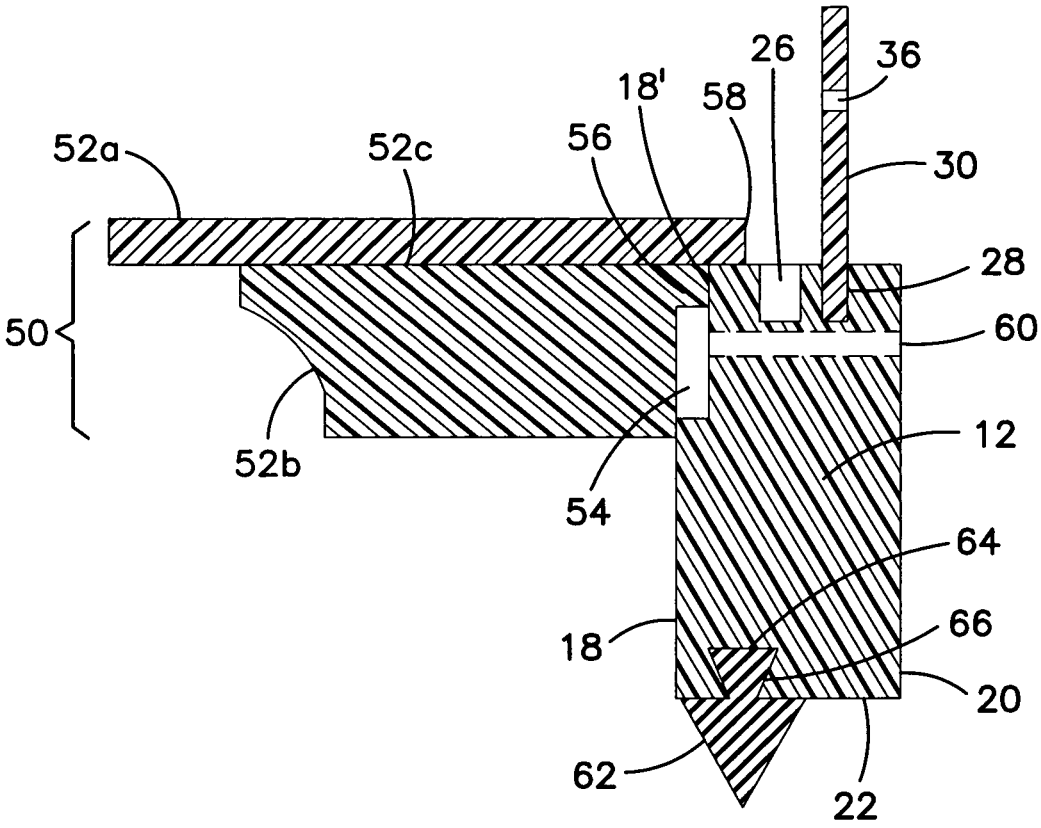
FIG. 2 is a section view taken along line 2-2 of FIG. 1.
Figure 3:
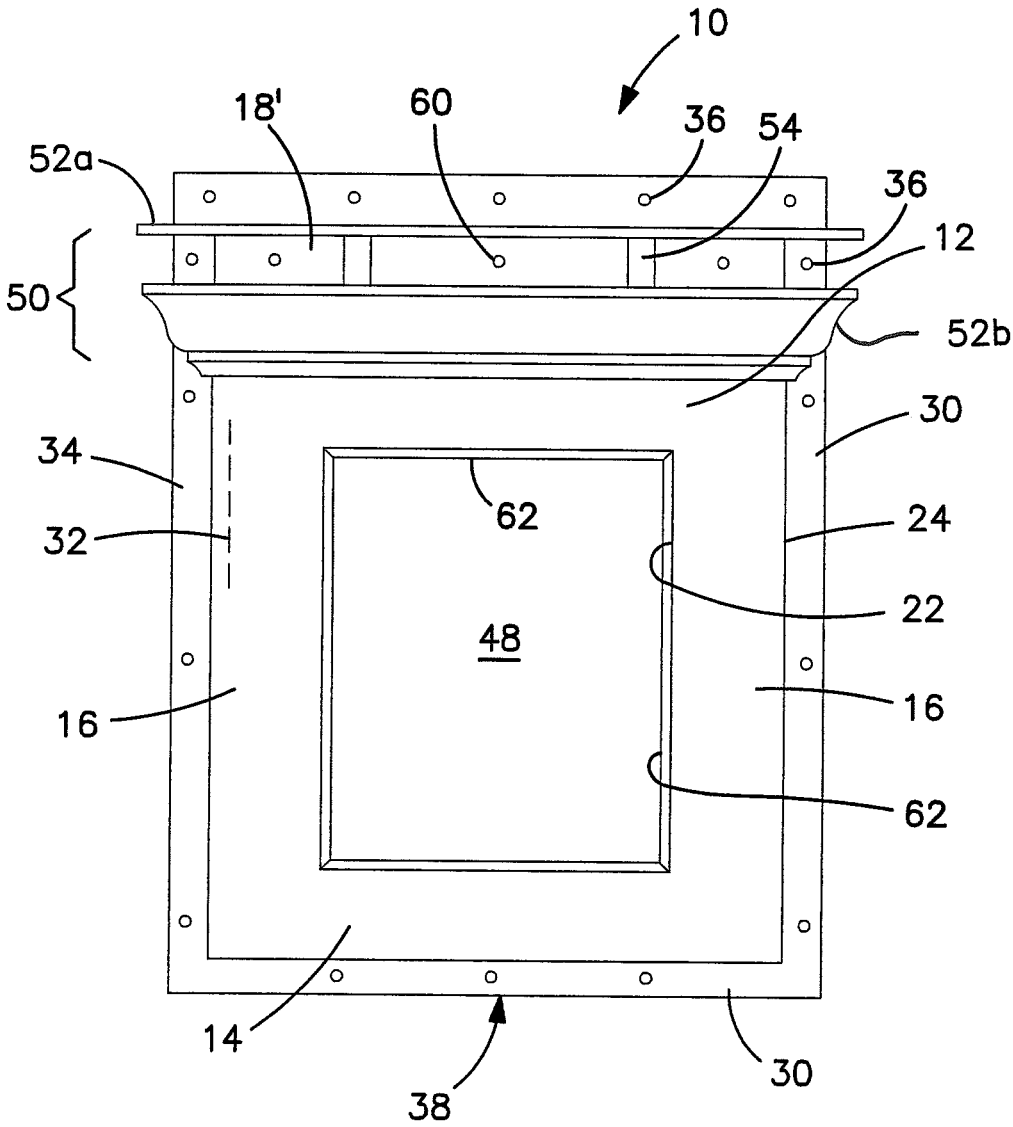
FIG. 3 is an elevation view of the window frame of FIG. 1, showing a movable portion of the moulding separated from the stationary portion of the moulding, to expose holes for attaching the trim body to the wall of a building.

FIGS. 1-3 show a prefabricated window frame 10, having top element 12, bottom element 14 and side elements 16 connected or configured together to define a rectangular frame, each element having front 18 and back faces, and inner 22 and outer 24 edges. At least the side elements 16, but preferably also the top and bottom elements 12, 14 have a channel 28 in which mounting strips 30 have been press fit. Optionally, the edges can also include another channel indicated at 26 in FIG. 2, to facilitate installation of vinyl or aluminum siding against the frame as described in U.S. Publication 2009/0277110. The inner edge 32 of the mounting strip 30 is retained well within the edge 22 of the frame, and the outer edge 34 of the strip extends outside the perimeter of the frame, where mounting holes 36 are provided in the strip.

Figure 4:
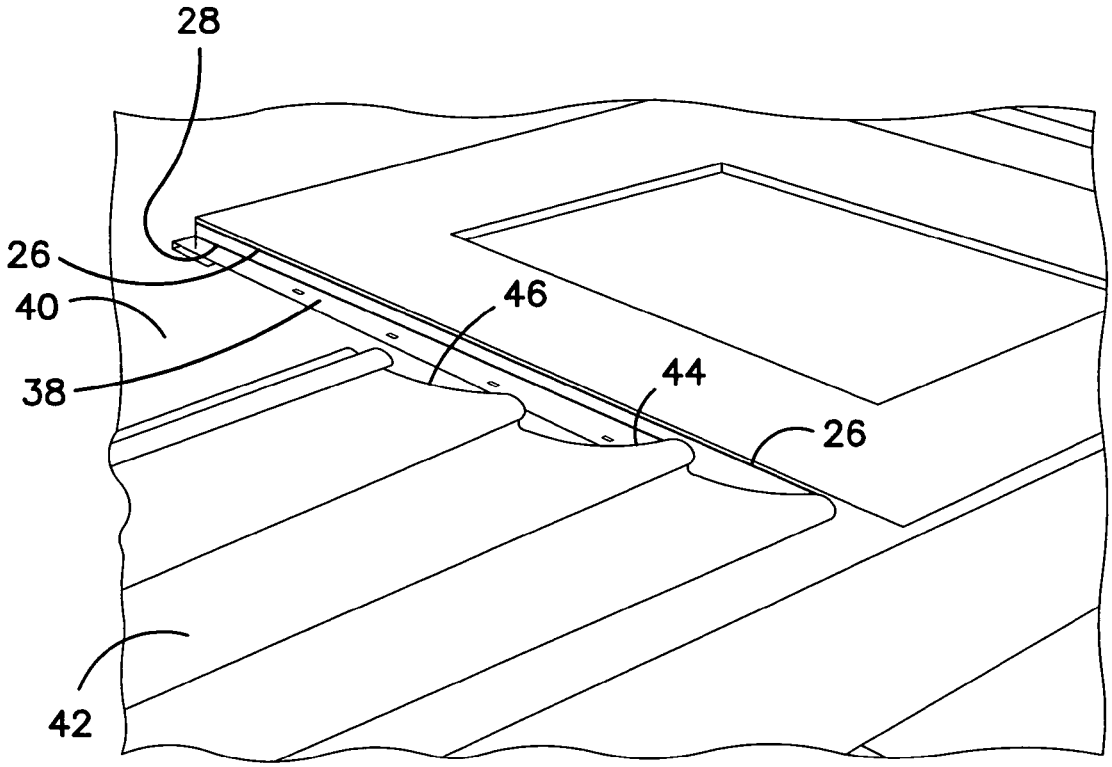
FIG. 4 is a perspective view of a preference in which the side elements of the window frame have a channel for receiving end edges of wall siding panels.

Whether prefabricated as an entire unit or assembled on site as such unit, the frame with strips and/or complete mounting flange 38 are placed around the window box or similar penetration with the back face 20 of the frame against the wall 40 as shown in FIG. 4. The flange 38 then is affixed to the wall, such as by nailing through holes 36 to arrive at a condition shown in FIG. 1. To accommodate the subsequent attachment of vinyl or aluminum siding 42 to the wall 40, the longitudinal end seams 44 and end edges 46 of the sliding panels are slid into the channel 26 of each frame element.

Although in a straightforward traditional manner the frame elements could be attached directly to the wall, this would require covering and careful painting over unsightly nail or screw heads. The use of mounting strips 30 or other indirect attachments that are hidden by the siding, avoids this labor intensive step. However, indirect attachment of the frame to the wall is generally not as strong as direct attachment. The present invention solves this problem by achieving direct attachment of at least one frame element, with or without indirect attachment of other frame elements, while avoiding the need to cover and paint nail or screw heads.

Preferably, before the vinyl siding is inserted and, in any event, where used with wood siding, an additional feature according to the present invention is relied upon to attach the frame to the building structure. The top frame element 12 (above the window opening 48) generally includes a decorative moulding 50, preferably consisting of a top board 52*a* and a base 52*b*. The top board 52*a* is permanently affixed near its inner edge 58, to the top of element 12. While the window frame is attached to the building by the mounting strips 30, the base 52*b* of the moulding is vertically slid downward from the top board 52*a*, to the position shown in FIG. 3. This is possible because the front 18 of element 12 includes a groove 54 indicated at 18' engaging a projection 56 in the base portion of the moulding 52*b*. The preferred dovetail joint 54, 56, permits displacement of the base 52*b* downwardly below the elevation of the through hole 60, as shown in FIG. 3. The installer can then further secure the frame to the building wall by connecting the rigid top element 12 to the wall with fasteners through hole 60. Preferably, the attachment holes 60 are not in the grooves 54, to avoid any interference between an installation nail or screw and the tongue portion 56 of the slidable moulding base 52*b*.

After the screws are installed through holes 60, the top surface 52*c* of the base 52*b* is glued and the base 52*b* is slid upward into contact with the top piece 52*b* and preferably clamped to complete the installation as shown in FIG. 1.

The entire trim unit, and especially the moulding, is preferably made of hard PVC plastic.

In a further improvement, the entire inside perimeter 22 of the window frame which defines the opening 48 for receiving the window box, includes a substantially continuous preinstalled gasket 62 which is preferably press fit with an enlarged portion 64 into a corresponding beveled groove 66. Conventionally, the inside perimeter 22 is a simple board edge and the window box must be caulked in. The preinstalled gasket saves the installer significant time.

It should be appreciated that the preinstalled gasket feature can be employed without the movable moulding previously described and, moreover, with any window frame regardless of installation technique onto the building wall.

Figure 5:
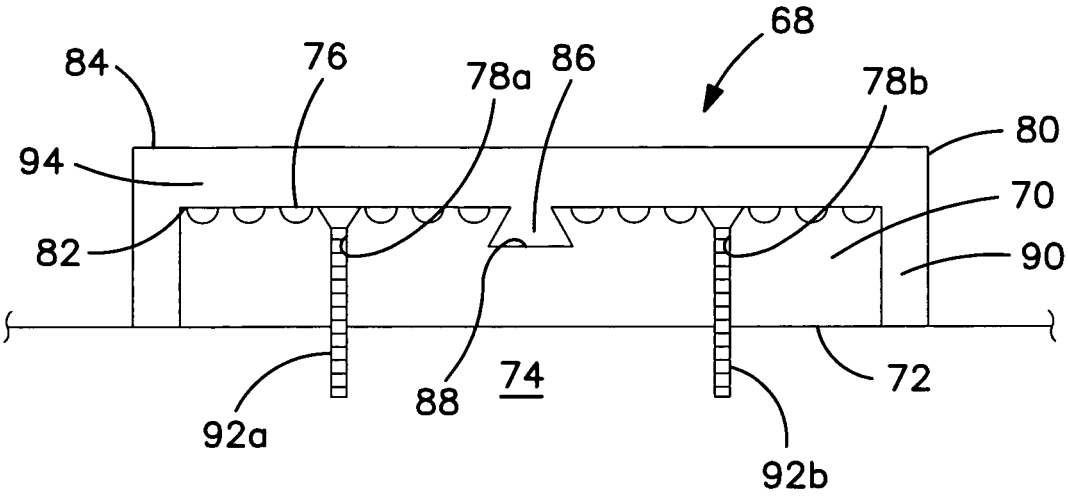
FIG. 5 is a section view of another embodiment showing the movable portion of the moulding of a trim unit on a partial column.

Another embodiment is shown in FIG. 5, where a construction trim member 68 in the form of a partial column or the like is shown in cross-section at the elevation where the body 70 has an installation side 72 bearing on or secured to the structural member 74 of the building, such as a wall, and a front side 76 opposite the installation side. At least one, and in this case two holes 78*a*, 78*b* pass from the front side 76 to the installation side 72. It should be appreciated that body 70 extends vertically a substantial distance along the building structure, typically at least one story.

The trim member 68 includes a decorative moulding 80, typically at the top and bottom of the vertically extending body 70. As an example, the section view of FIG. 5 can be considered as through the finally installed trim member 68. The moulding 80 has a back side 82 and a front side 84. The back side 82 includes an elongated protrusion such as tongue 86 that fits into a corresponding tapered groove 88 in the body 70, providing a sliding relationship whereby the holes 78*a*, 78*b* are exposed for penetration the nails or screws 92*a*, 92*b* before the movable moulding portion 80 is slid into its final position covering the groove 88 and the nails 92. It should be appreciated, that in a manner similar to that described with respect to FIGS. 1-3, the movable moulding portion 80 can have a flat top surface 94 that can be glued to a moulding top element which is not shown in FIG. 5 but would rigidly project from the top of the body 70 such that the movable portion 80 is permanently joined to the top element portion of the moulding.

In the illustrated embodiment, the moulding portion 80 has a generally inverted, squared-off "C" shape, with side portions 90 extending perpendicularly from the back surface 82. According to the invention, the moulding 80 portion would still be slidable and attachable in the same manner as described above, even if the side portions 90 were not present, because these are not relied on either for the relative sliding or for laterally stabilizing the moulding movable part relative to the body.

Figure 6:
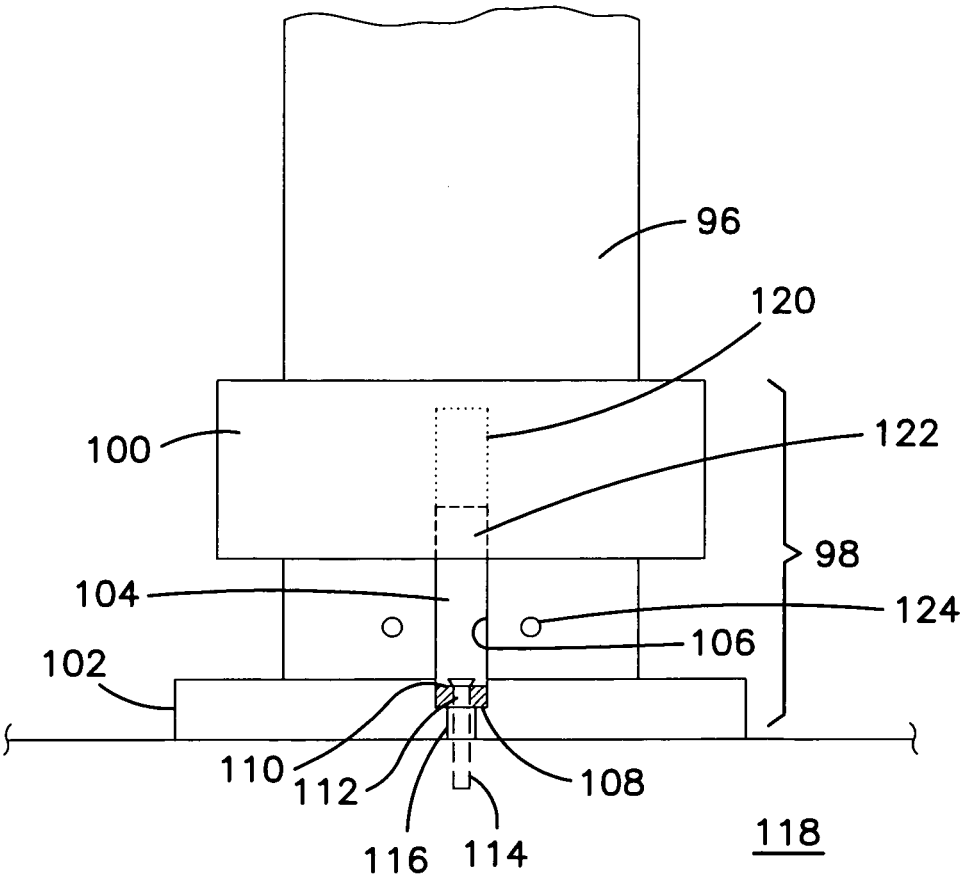
FIG. 6 shows a third embodiment of a trim unit, for a column, having a body and a composite moulding at the bottom of the column.

FIG. 6 shows another embodiment of a column trim unit having a body 96 and a composite moulding 98, at the bottom of the column. The moulding has a stationary part 102 that is permanently secured to a cement or wooden base in the manner to be described, and a movable base portion 100 which upon completion of the installation will rest on the portion 102. The trim body 96 has a cutout or groove 106 in which a rigid, L-shape bracket 104 is flush with the visible or front side of the body 96. Transverse bracket portion 108 projects outwardly from the drawing plane relative to the elongated portion of the bracket. The upper surface 110 of the projection 108 is spaced slightly below the upper surface of the groove 110 provided in the stationary portion 102 of the moulding. The projection 108 includes a hole 112 through which a screw 114 passes through the stationary portion 102 into the concrete or the like 118. A through bore 116 can optionally be provided for this purpose. After the trim body 96 has been firmly secured to the floor 118 by means of the bracket 104 and screw or bolt 114, the movable portion 100 of the moulding can be slid down and glued against the stationary portion 102. This sliding is achieved by a continuation of groove 106 upwardly as shown at 122, and a corresponding projection 120 on the back side of movable member 100 which slides in the groove. Holes 124 corresponding to 78*a* and 78*b* in FIG. 5 can optionally be provided to secure the body portion 96 of the trim to the wall or post before the moulding portion 100 is slid down to portion 102.

Figure 7:
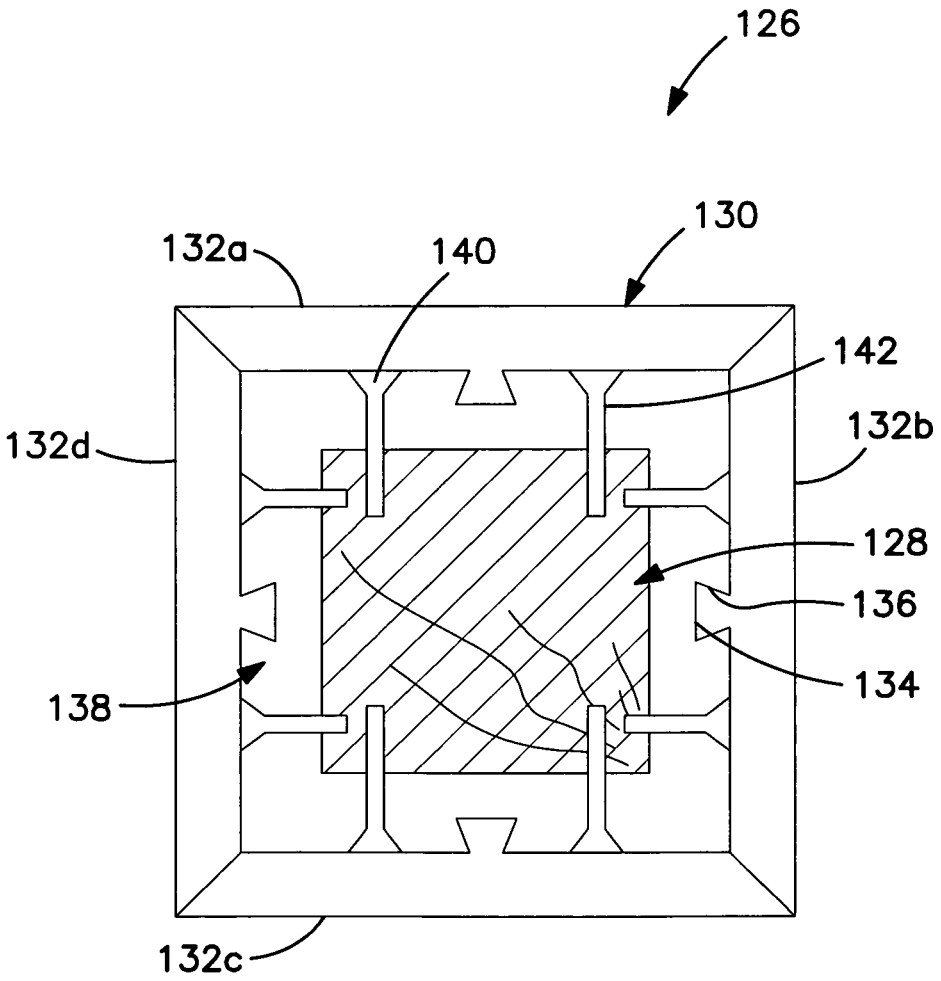
FIG. 7 shows a fourth embodiment of a trim unit for a wooden post, whereby all four sides of the post can be covered with a decorative trim.

FIG. 7 shows another embodiment of a trim unit 126 whereby four sides of a square wooden post 128 can be covered with a decorative trim piece 130. This view is similar to that shown in FIG. 5, i.e., without showing the top piece of the moulding, onto which the movable portions are glued as the final step in the installation. In this embodiment, each of the four substantially flat mold bases 132*a-d* has a projecting tongue or the like 134 which mates with a corresponding groove 136 in the rectangular, vertically elongated trim body 138. Each body has holes 140 on either side of the corresponding groove for receiving nails or screws 142. It should be appreciated that each of the movable moulding portions 132*a-d* relies only on the corresponding dovetail joint for both sliding and lateral stability.

Although not shown, each of the grooves in the previously described embodiments can have a lead-in which permits the initial overlap of the movable portion of the moulding relative to the body of the trim member, after which the permanent portion of the moulding can be secured to the body.

The invention claimed is:

1. A building construction trim unit attached to a vertical surface of a structural member of a building, comprising:

a body having a pair of generally vertically parallel side elements and a first horizontal element extending transversely between said side elements at an upper terminal end of said body, and a decorative moulding connected to the first horizontal element;

said body having an installation side vertically abutting the vertical surface of said structural member of the building and a front side opposite the installation side, with a plurality of holes passing from the front side to the installation side of the first horizontal element;

wherein the structural member is a building wall having a border around a wall penetration and the trim unit is a frame attached to the border around said penetration; and said connection is slidable in a direction generally vertically perpendicular to the first horizontal element and parallel with the side elements between the moulding and the first horizontal element whereby in a first position the moulding exposes the holes to receive a fastener into the structural member and in a second position the moulding covers the holes.

2. The trim unit of claim 1, wherein the slidable connection self-retains the moulding onto the body of the trim unit.

3. The trim unit of claim 2, wherein the holes are defined horizontally adjacent the slidable connection.

4. The trim unit of claim 2, wherein, the moulding has a stationary member fixed to the body and a base member slidably connected to the first horizontal element between said first and second positions; and in the second position the base member abuts the stationary member.

5. The trim unit of claim 4, wherein the body is attached to the structural member via a plurality of fasteners, each of the fasteners received in one of the holes;

the base member is adhered to the stationary member in the second position such that said base member is retained in said second position.

6. The trim unit of claim 1, wherein the slidable connection is a dovetail joint.

7. The trim unit of claim 1, wherein the trim unit is a window frame having a second horizontal element parallel to the first horizontal element and extending transversely between said generally vertically parallel side elements at a bottom terminal of said body; and the moulding is slidable on the first horizontal element.

8. The trim unit of claim 1, wherein, the moulding has a stationary member fixed to the first horizontal element and a base member slidably connected to the first horizontal element between said first and second positions and in the second position the base member abuts the stationary member.

9. The trim unit of claim 8, wherein the first horizontal element has an upper edge;

the stationary member is a top board rigidly attached to the upper edge at a top board inner edge and includes a horizontally extending lower flat surface;

the front side of the first horizontal element has a groove running vertically, beneath the stationary member, and said holes are situated in the groove; and the base member includes a horizontally extending flat upper surface and is connected to the first horizontal element by a projection that vertically slides in said groove such that in the second position the upper surface of the base member abuts the lower surface of the stationary member, and the base member completely covers the groove.

10. The trim unit of claim 8, wherein the body is attached to the structural member via a plurality of fasteners, each of the fasteners received in one of the holes; and the base member is adhered to the stationary member in said second position.

11. A building construction trim unit attached to a vertical surface of a structural member of a building, comprising:

a body having a pair of generally vertically parallel side elements and a first horizontal element extending transversely between said side elements at an upper terminal end of said body, and a decorative moulding connected to the first horizontal element;

said body having an installation side vertically abutting the vertical surface of said structural member of the building and a front side opposite the installation side, with a plurality of holes passing from the front side to the installation side of the first horizontal element;

wherein said connection is slidable in a direction generally vertically perpendicular to the first horizontal element and parallel with the side elements between the moulding and the first horizontal element whereby in a first position the moulding exposes the holes to receive a fastener into the structural member and in a second position the moulding covers the holes; and the trim unit is a window frame having an internal perimeter defining a window box opening and said perimeter has a continuous gasket retained therein.

12. A trim unit for attachment to a vertical structural member of a building comprising:

a body having upper and lower portions, an installation side for vertically abutting the structural member and a front side opposite the installation side, and a first hole passing from the front side to the installation side; wherein a first decorative moulding is oriented transverse to a direction between the upper and lower portions of the body, and slidably connected to the body for vertical movement along said direction, between a first position wherein the first hole is exposed to receive a fastener and a second position wherein the first moulding covers the first hole;

the moulding has a stationary member fixed to the body and extending transversely with a flat lower surface and a base member extending transversely with a flat upper surface and which is slidably connected to the body between said first and second positions; and in the second position the upper surface of the base member abuts the flat lower surface of the stationary member.

13. The trim unit of claim 12, wherein, the structural member of the building is a flat vertical wall;

the body has a flat vertical portion having upper and lower terminal ends and abutting said wall;

the first decorative moulding is vertically slidable at one of the upper or lower ends of the body along said body portion in a vertical dovetail joint; and the body is fastened to said wall through said first hole and a second hole, said first and second holes defined adjacent to and on either horizontal side of the dovetail joint.

* * * * *